United States Patent [19]

Rowan

[11] 4,030,145

[45] June 21, 1977

[54] COMBINATION PLUMBING FIXTURE HAVING SINGLE FLOOR WASTE OUTLET

[75] Inventor: Frank E. Rowan, Burlingame, Calif.

[73] Assignee: Aluminum Plumbing Fixture Corporation, Burlingame, Calif.

[22] Filed: Feb. 12, 1976

[21] Appl. No.: 657,474

[52] U.S. Cl. ..... 4/10; 4/166; 4/DIG. 15; 4/3

[51] Int. Cl.² ..... E03D 1/00; E03D 3/00; E03D 5/00

[58] Field of Search ..... 4/1, 2, 3, 4, 10, DIG. 15, 4/170, 166, 191, 29

[56] References Cited

UNITED STATES PATENTS

| | | | |
|---|---|---|---|
| 1,868,760 | 7/1932 | Norberg | 4/3 |
| 1,935,779 | 11/1933 | Kemach | 4/3 |
| 2,343,896 | 3/1944 | Fishko | 4/191 X |
| 2,819,926 | 1/1958 | Wood | 4/191 X |
| 2,860,348 | 11/1958 | McClanahan | 4/3 |
| 3,015,827 | 1/1962 | Iwata | 4/67 R |
| 3,458,871 | 8/1969 | DiValcervo | 4/3 |
| 3,696,448 | 10/1972 | Carfora | 4/3 |
| 3,722,152 | 3/1973 | Schlatter et al. | 4/DIG. 15 |
| 3,789,436 | 2/1974 | Maier-Gerber | 4/166 |
| 3,932,899 | 1/1976 | Brady et al. | 4/3 |

*Primary Examiner*—Henry K. Artis
*Attorney, Agent, or Firm*—Robert G. Slick

[57] ABSTRACT

A combination plumbing fixture is provided for institutional use which combines a toilet, wash basin and drinking fountain. Both the water and the waste connections are made through the floor, making it adaptable for use in buildings which do not have a pipe chase.

3 Claims, 3 Drawing Figures

COMBINATION PLUMBING FIXTURE HAVING SINGLE FLOOR WASTE OUTLET

SUMMARY OF THE INVENTION

The present invention relates to a combination plumbing fixture which combines a toilet, wash basin and drinking fountain in a single unit. The combination fixture is particularly adapted for use in penal and metal institutions where space is at a premium and breakage, either accidental or deliberate, is a problem.

Various combination fixtures suitable for institutional use have been provided in the past, but ordinarily at least some of the plumbing connections have been made through the rear of the unit, necessitating a space between the walls for the installation of the inlet and waste pipes. This is wasteful of space so that such fixtures are not suitable for use where space is at a premium or in the case of old buildings which are not provided with wall space for piping.

The unit of the present invention is made completely of stainless steel with no sharp edges so that it is substantially impossible for an inmate to harm himself. The valves are all of the concealed type with a self-closing feature so that it is difficult, if not impossible, for the inmate to do any damage to the fixture or to waste water.

The toilet bowl can be located in different positions on the fixture, so that the fixture can be mounted in a corner to occupy a minimum amount of space.

Accordingly, the present invention provides a substantially indestructible combination fixture for use by institutions which occupies a minimum amount of floor space, which is adapted for corner mounting and in which all of the plumbing is brought out through the bottom of the unit.

Various other features and advantages of the invention will be brought out in the balance of the specification.

DESCRIPTION OF THE PREFERRED EMBODIMENTS

Figure 1:
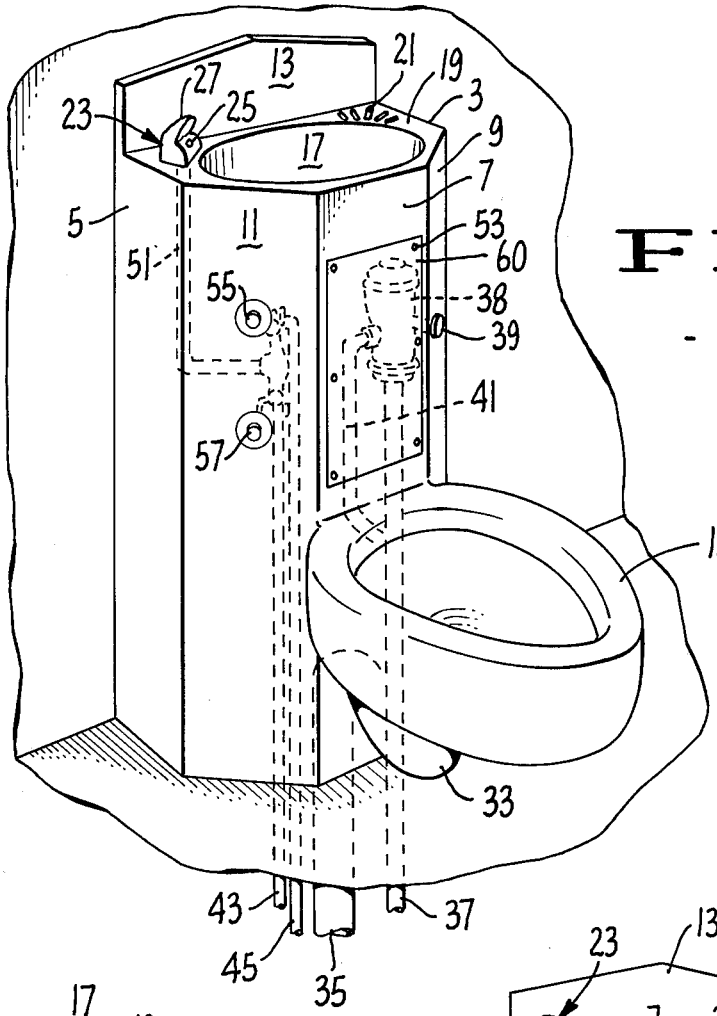
FIG. 1 is a perspective view of a combination fixture embodying the present invention.
Figure 2:
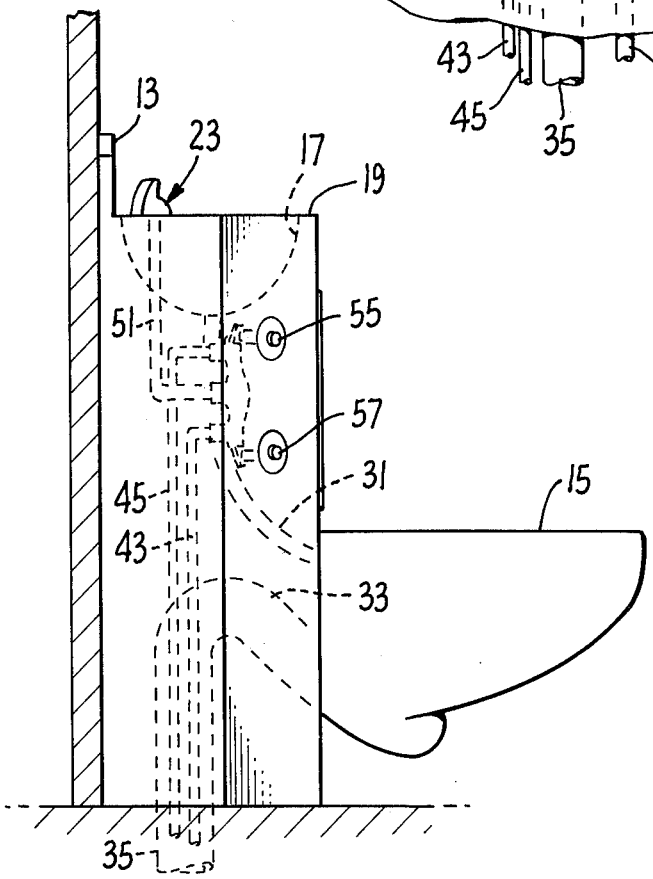
FIG. 2 is a side view of the fixture.
Figure 3:
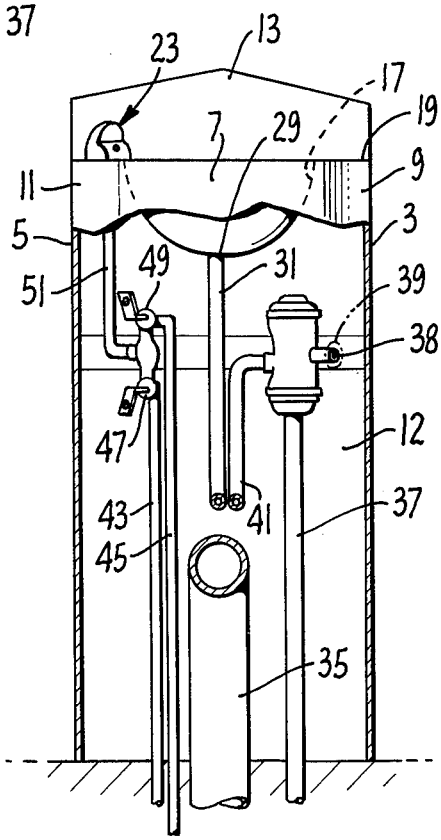
FIG. 3 is a front view of the fixture with certain parts cut away to show the internal structure.

Referring now to the drawings by reference characters the fixture has sides 3 and 5, and a front panel 7 which are connected together by panels 9 and 11. Panels 9 and 11 are the same width as panel 7. At the top of the panels a wash basin 17 is provided which has a rim 19 with raised portions 21 forming a self-draining soap holder. Backsplash 13 is connected to basin 17.

All of the parts described are fabricated from stainless steel and welded together to provide a smooth, single piece structure.

A sanitary bubbler 23 is provided over the basin 17 which has a single outlet 25 and a guard 27. The fixture 23 serves as a drinking fountain and also as a filler for the bowl. The bowl itself is provided with a small opening drain 29 so that it is not necessary to provide a stopper for the bowl. The outlet from the bowl 29 drains through pipe 31. Thus, any water which drains out of the wash basin drains directly into the toilet bowl 15, so that a separate waste connection is not needed.

The toilet bowl has the usual trap 33 and a pipe 35 for discharging waste through the floor. A pipe 37 for flushing water is provided which leads to a flush valve

38 which has the usual push-button 39 for flushing which extends out through panel 9. The flushing water is directed to the toilet bowl through line 41.

A hot water pipe 43 and a cold water pipe 45 lead to valves 47 and 49 which are connected through pipe 51 to the outlet 23. Of course, the cold water pipe 45 might be combined with the waste inlet pipe 35 in many instances or can be separated, as shown, if the toilet is to be flushed with non-potable water.

Valves 47 and 49 are mounted on panel 11. The valve actuating buttons 55 and 57 extend from the panel 11. Access to the valves and piping is through subpanel 60 which is attached to panel 7 by means of theft-proof bolts 53.

Panels 7, 9 and 11 are of substantially the same size so that the bowl 15 can be mounted on any of the panels, adapting the fixture for installation in various building configurations.

It is believed obvious in the foregoing that I have provided a new and useful combination plumbing fixture which is adapted for use by institutions and which does not require the usual pipe chase for making connections for water and waste.

I claim:

1. A combination plumbing fixture comprising:

a generally horizontal, completely enclosed column-like body having a base, a top, and an access opening defined therein between said base and said top, said body being mounted on a floor;

a wash basin positioned on said body top;

a toilet bowl mounted on said body to be located between said access opening and said base and extending outwardly therefrom;

a combination drinking fountain and faucet mounted on said body top to introduce water into said wash basin;

a cover plate covering said access opening;

a flush valve for controlling flushing of said toilet bowl, said flush valve being positioned within said body;

shutoff valves for controlling flow of hot and cold water into said combination drinking fountain and faucet, said shutoff valves being located within said body;

a basin drain pipe located within said body and connecting said wash basin to said toilet bowl so that water from said basin drains into said toilet bowl; and main conduits for conducting water to said combination and to said toilet bowl via said shutoff and flush valves respectively, and a connecting conduit connecting said flush valve with said toilet bowl, said conduits all being located within said body, said main conduits extending in an essentially vertical direction through the floor into said body through said body base, said fixture being completely self-contained and mounted on the floor with all plumbing connections being made through the floor;

said shutoff and flush valves being located adjacent said access opening so that said valves are accessible through said access opening.

2. The combination defined in claim 1, further including a plurality of theft-proof bolts securing said cover plate to said body.

3. The combination of claim 1, further including control valves for said flush valve and said shutoff valves, said control valves being mounted on the outside of said body.

* * * * *